US005556265A

United States Patent [19]

Michiyuki et al.

[11] Patent Number: 5,556,265

[45] Date of Patent: Sep. 17, 1996

[54] MULTI-PISTON TYPE REFRIGERANT COMPRESSOR WITH MEANS FOR DAMPING SUCTION AND DISCHARGE GAS PULSATION

[75] Inventors: Hiromi Michiyuki; Hayato Ikeda; Masanobu Yokoi; Hisato Kawamura, all of Kariya, Japan

[73] Assignee: Kabushiki Kaisha Toyoda Jidoshokki Seisakusho, Aichi, Japan

[21] Appl. No.: 538,411

[22] Filed: Oct. 2, 1995

[30] Foreign Application Priority Data

Oct. 5, 1994 [JP] Japan ..... 6-241591

[51] Int. Cl.[6] ..... F04B 39/12

[52] U.S. Cl. ..... 417/312; 181/403

[58] Field of Search ..... 417/269, 312, 417/313; 181/403

[56] References Cited

U.S. PATENT DOCUMENTS

| | | | |
|---|---|---|---|
| 3,577,891 | 5/1971 | Nemoto et al. | 417/312 |
| 3,785,751 | 1/1974 | Nemoto et al. | 417/312 |
| 4,432,702 | 2/1984 | Honzawa et al. | 417/269 |
| 4,793,775 | 12/1988 | Peruzzi | 417/312 |
| 4,863,356 | 9/1989 | Ikeda et al. | 417/312 |
| 5,051,069 | 9/1991 | Ikeda et al. | 417/312 |
| 5,288,212 | 2/1994 | Lee | 181/403 |

*Primary Examiner*—Peter Korytnyk
*Attorney, Agent, or Firm*—Burgess, Ryan and Wayne

[57] ABSTRACT

A multi-piston type refrigerant compressor having a cylinder block unit in which a plurality of cylinder bores receiving a plurality of reciprocating pistons for sucking a refrigerant gas, compressing the refrigerant gas, and discharging the compressed refrigerant gas, and a piston reciprocating actuating mechanism are housed, and a muffling unit defined by upright walls integral with the cylinder block unit and including a suction pulsation damping chamber, a discharge pulsation damping chamber, and an arrangement in which the covering plate of the muffling chamber, having ports formed so as to fluidly connect suction and delivery gas pipes to the muffling chamber, is arranged to be inclined, with respect to a horizontal plane, towards one of the cylinder block units.

8 Claims, 6 Drawing Sheets

MULTI-PISTON TYPE REFRIGERANT COMPRESSOR WITH MEANS FOR DAMPING SUCTION AND DISCHARGE GAS PULSATION

BACKGROUND OF THE INVENTION

1. Field of the Invention

The present invention relates to a refrigerant compressor such as a swash plate type refrigerant compressor adapted for being used in an airconditioning or a climate control system of automobiles, and more particularly, it relates to a multi-piston type refrigerant compressor provided with a muffling unit in which damping of both suction and discharge gas pulsations is achieved.

2. Description of the Related Art

U.S. Pat. No. 4,534,710 discloses a multi-piston swash plate type compressor provided with a muffling unit having therein suction and discharge damping chambers. The muffling unit of the multi-piston type compressor of U.S. Pat. No. 4,534,710 is formed by outer walls extending upwards from the outer circumference of the cylinder block of the compressor. In the muffling unit, the suction and discharge pulsation damping chambers are separately defined to respectively deaden suction gas pulsation and discharge gas pulsation. The uppermost opening of the muffling unit is sealingly covered by a flat covering plate which extends horizontally when the compressor is mounted in an engine compartment of an automobile. Nevertheless, a suction pipe for introducing a refrigerant gas before compression from an airconditioning system into the compressor and a discharge pipe for discharging the compressed refrigerant gas toward the airconditioning system are connected to suction and discharge ports formed in the two mutually rectangular upright walls of the muffling unit, and therefore, when the compressor is mounted in an engine compartment of an automobile, an operator finds difficulty in arranging refrigerant-gas pipes and hoses in the narrow space available within the engine compartment.

Another conventional multi-piston type compressor is provided with a muffling unit integral with the cylinder block of the compressor, shown in FIGS. 5 and 6, in which an arrangement and an outer shape of the muffling unit is similar to that of the compressor of U.S. Pat. No. 4,534,710. However, the suction and discharge pipes for introducing the refrigerant gas before compression and discharging the compressed refrigerant gas are connected to suction and discharge ports formed in the flat covering plate of the muffling unit so that;the suction and discharge pipes extend in parallel with one another.

Thus, when the compressor is mounted in an engine compartment of an automobile, the posture of the compressor is in that the covering plate of the muffling unit generally extends horizontally. In order to connect the suction and discharge pipes to the suction and discharge ports of the covering plate, these pipes must have a right-angle pipe end having one end connected to the suction or discharge port of the covering plate and the other end from which a lateral portion of the suction or discharge pipe horizontally extends. Thus, the latter conventional multi-piston type refrigerant compressor creates various problems as set forth below.

(1) An additional space is required in the engine compartment to connect the respective right-angle pipe ends of the suction and discharge pipes to the suction and discharge ports of the covering plate of the integral muffling unit of the compressor.

(2) The suction and discharge damping chambers separated from one another by a partition wall within the muffling unit have an identical vertical depth, and therefore, the partition wall has a large surface area through which the heat of the compressed refrigerant gas in the discharge damping chamber is transmitted to the refrigerant gas before compression (the suction gas) in the suction damping chamber. Accordingly, the suction gas is warmed before it enters the suction chamber or chambers of the compressor, and the density of the suction gas is reduced. Therefore, when the warmed suction gas is continuously compressed, the compression efficiency of the compressor is necessarily lowered.

(3) The outer upright walls and the separation wall of the muffling unit are very high, and therefore, the weight of the compressor provided with the integral muffling unit is large.

SUMMARY OF THE INVENTION

An object of the present invention is therefore to provide a multi-piston type refrigerant compressor provided with an integral muffling unit, which can solve the above problems caused by the muffling unit of the conventional refrigerant compressor.

Another object of the present invention is to provide a multi-piston type refrigerant compressor provided with an integral muffling unit, which can obviate any difficulty in an operation for arranging gas pipes and hoses when the compressor is mounted in and fixed in a small mounting region present in an engine compartment of an automobile, and also can reduce the weight of the compressor.

A further object of the present invention is to provide a multi-piston type refrigerant compressor provided with an integral muffling unit, which can have a compression efficiency thereof higher than that of the conventional refrigerant compressor having an integral muffling unit.

In accordance with the present invention, there is provided a multi-piston type refrigerant compressor provided with a muffling unit, which comprises:

a cylinder block means having a horizontally extending central axis, and a generally cylindrical body portion defined around the central axis and having a plurality of cylinder bores arranged equidistantly around the horizontal central axis;

a plurality of piston elements reciprocating in the plurality of cylinder bores to implement suction of a refrigerant gas, compression of the refrigerant gas, and discharge of the compressed refrigerant gas;

an upright wall means extending from an upper portion of the cylindrical body portion so as to define an enclosed upright chamber having an upward opening, the enclosed upright chamber having an appreciable volume; and a plate-like covering means for covering the upward opening of the enclosed upright chamber so as to form the muffling means unit including a suction pulsation damping chamber and a discharge pulsation damping chamber separated from the suction pulsation damping chamber by a partition wall means arranged in the enclosed upright chamber, the plate-like covering means being provided, therein, with a suction gas introducing port to which a suction gas pipe is connected, and a discharge gas delivering port to which a discharge gas pipe is connected, wherein the upright wall means is formed so as to define an uppermost end thereof extending around the upward opening and lying in a plane inclined by a predetermined angle with respect to a horizontal plane containing therein the horizontal central axis of the cylindrical body of the cylinder block means to thereby allow the plate-like covering means to be inclined by the same predetermined angle.

FIG. 4 illustrates the preferred arrangement where, the suction pulsation damping chamber is situated lower than the discharge pulsation damping chamber with respect to the horizontal plane containing therein the horizontal central axis of the cylindrical body of the cylinder block means.

Preferably, the suction pulsation damping chamber and the discharge pulsation damping chamber of the muffling chamber means are provided with a bottom surface arranged opposite to the upright opening of the muffling unit, respectively, and the bottom surface of the discharge pulsation damping chamber is recessed into the cylindrical body portion.

The upright wall means may be integral with the cylindrical body portion of the cylinder block means.

The plate-like covering means may be formed to be integral with the upright wall means.

BRIEF DESCRIPTION OF THE DRAWINGS

The above and other objects, features, and advantages of the present invention will be made more apparent from the ensuing description of the preferred embodiment thereof in conjunction with the accompanying drawings wherein.

DESCRIPTION OF THE PREFERRED EMBODIMENT

Before beginning the description of the preferred embodiment of the present invention, a brief explanation of the muffling unit integrally provided for a multi-piston-swash-plate type refrigerant compressor according to the prior art will be provided below with reference to FIGS. 5 and 6.

Figure 5:
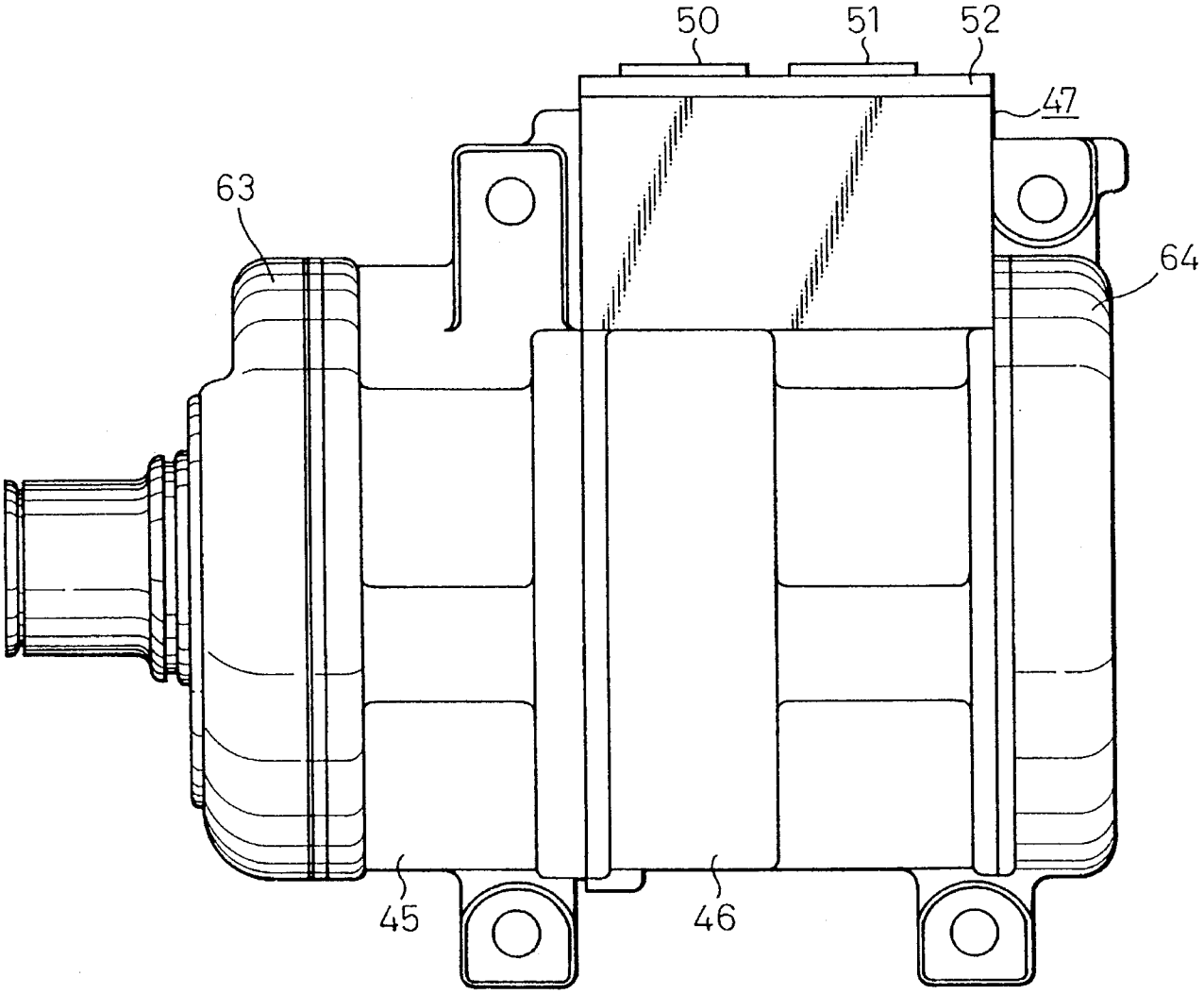
Fig. 5 (PRIOR ART)
FIG. 5 is an outer view of a multi-piston-swash plate type refrigerant compressor provided with an integral muffling unit according to the prior art; and, FIG. 6 is a cross-sectional view of the prior art compressor of FIG. 5, illustrating an arrangement of the muffling unit according to the prior art.
Figure 6:
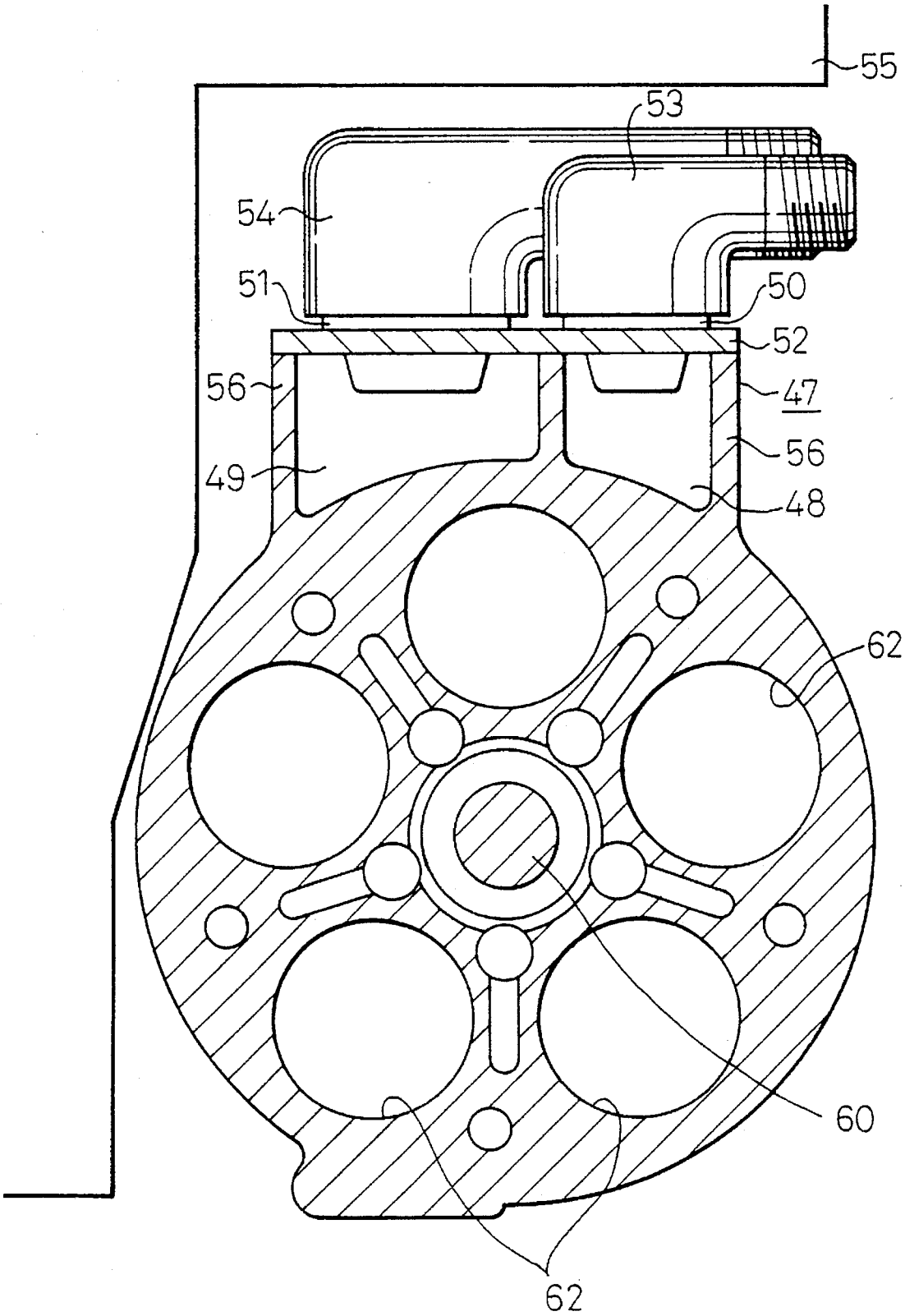
Fig. 6 (PRIOR ART)

Referring to FIGS. 5 and 6, the multi-piston-swash- plate type refrigerant compressor is provided with axially combined cylinder blocks 45 and 46 in which a plurality of cylinder bores 62 are formed around a longitudinal axis of the combined cylinder blocks. The compressor is mounted in an engine compartment of an automobile in such a posture that the longitudinal axis of the combined cylinder lies substantially horizontally.

The combined cylinder blocks 45 and 46 are further provided with a swash plate chamber (not shown) for accommodating therein a known swash plate mechanism to drive reciprocation of pistons (not shown) in the cylinder bores 62 in response to rotation of an axial drive shaft 60. The reciprocation of the respective pistons in the cylinder bores 62 causes suction of refrigerant gas before compression into the cylinder bores 62 from suction chambers formed in the front and rear housings 63 and 64 attached to the axial ends of the combined cylinder block 45 and 46, compression of the sucked refrigerant gas in the respective cylinder bores 62, and discharge of the compressed refrigerant gas from the cylinder blocks 62 into discharge chambers formed in the front and rear housings 63 and 64.

The compressor according to the prior art is provided with a muffling unit 47 formed integrally with the combined cylinder blocks 45 and 46 at an upper portion of the outer circumference of the cylinder blocks 45 and 46. The muffling unit 47 includes therein a suction pulsation damping chamber 48 for attenuating the pulsation of the refrigerant gas when it is introduced into the compressor from an airconditioning system, and a discharge pulsation damping chamber 49 for attenuating the pulsation of the compressed refrigerant gas before being delivered from the compressor toward the airconditioning system. The upper end of the muffling unit 47 is closed by a covering plate 52 which is provided therein with a connecting port 50 to which a suction gas pipe 53 for introducing the refrigerant gas into the suction pulsation chamber 48 is airtightly connected, and a different connecting port 51 to which a delivery gas pipe 54 for delivering the compressed refrigerant gas toward the airconditioning system is airtightly connected.

The muffling unit 47 is defined by an upright wall 56 extending upward from the cylinder blocks 45 and 46, the uppermost end of the upright wall 56 is closed by the covering plate 52 which is at a horizontal position in the engine compartment. Thus, as best shown in FIG. 6, the suction gas pipe 53 and the delivery gas pipe 54 are necessarily provided, at an end thereof, with a vertical neck by which the suction and delivery pipes 53 and 54 can be connected to the connecting port 50 and 51, and a lateral pipe portion of the suction and delivery pipes 53 and 54 extends horizontally from the uppermost end of the vertical neck so that a running hose (not shown) arranged in the engine compartment of an automobile is connected to the end of the lateral pipe portion of the suction gas pipe 53 and the delivery gas pipe 54. The above-mentioned neck of the suction and delivery pipes 53 and 54 requires a large space below another automobile part 55, and makes it difficult to acquire a mounting region for the compressor in the small engine compartment. As a result, an operation for arranging the suction and delivery pipes 53 and 54 and the running hoses becomes cumbersome.

Further, it should be understood that the suction and discharge pulsation damping chambers 48 and 49 have an identical depth as shown in FIG. 6. Therefore, the suction refrigerant gas in the suction pulsation damping chamber 48 must be subjected to heat transmitted from the compressed refrigerant gas in the discharge pulsation damping chamber 49 through a partition wall between the two chambers 48 and 49, which has a large surface area, before the suction refrigerant gas flows toward the suction chambers in the front and rear heads. Accordingly, the density of the suction refrigerant gas is reduced to cause a reduction in the compression efficiency of the compressor. Moreover, the upright wall 56 is generally tall so as to increase the inner volume of the muffling unit 47 which results in an undesirable increase in the weight of the entire compressor.

The present invention was made so as to overcome the above-mentioned various problems encountered by the muffling unit 47 of the multi-piston swash plate type refrigerant compressor according to the prior art.

Figure 3:
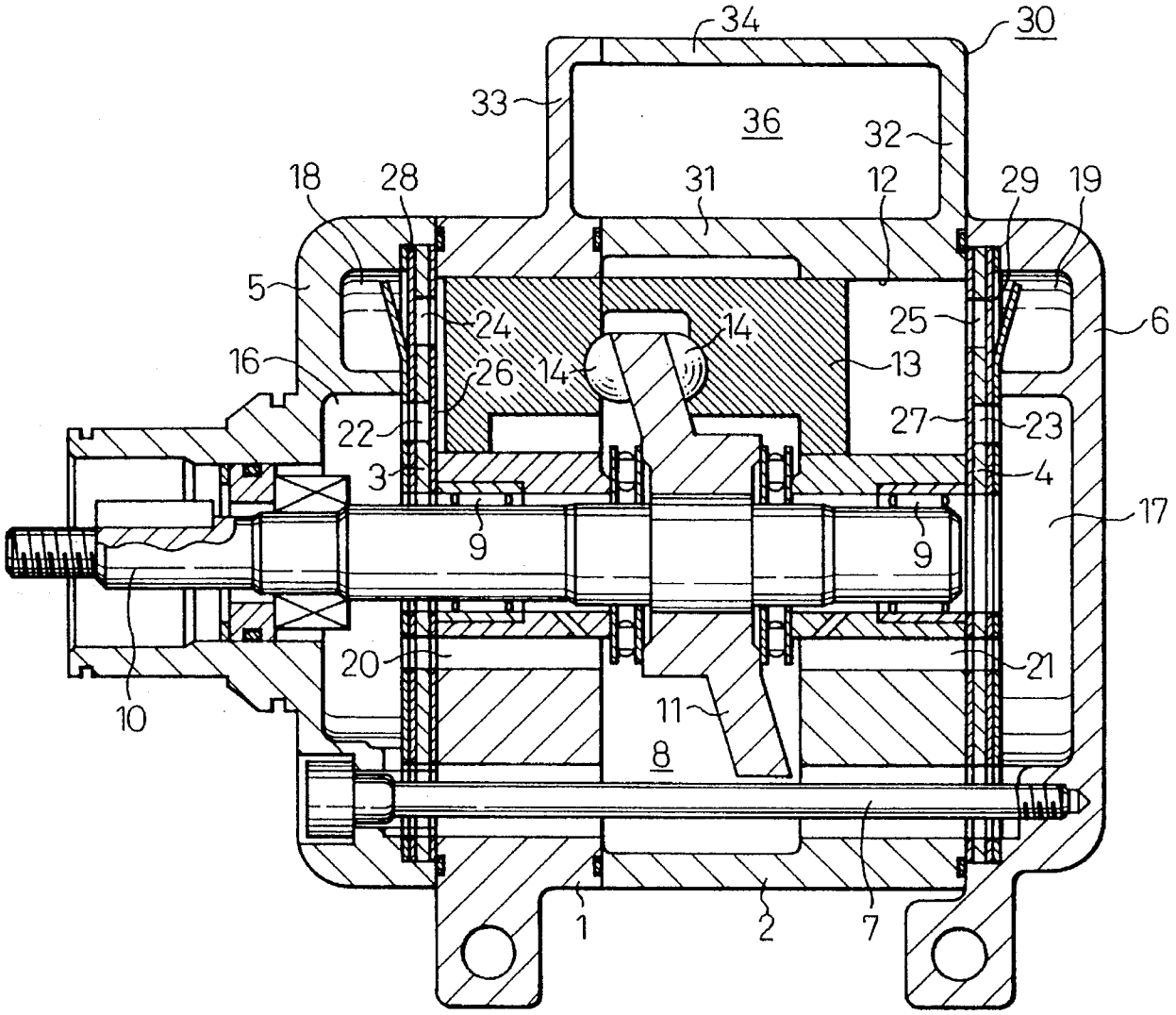
FIG. 3 is a longitudinal cross-sectional view of the swash plate type refrigerant compressor of FIG. 1.

Referring first to FIG. 3, a multi-piston swash plate type refrigerant compressor according to an embodiment of the present invention is provided with front and rear cylinder blocks 1 and 2 axially combined by a plurality of long screw bolts 7 and having a generally cylindrical body formed around a central axis extending horizontally. The front and rear ends of the combined cylinder blocks 1 and 2 are sealingly closed by front and rear housings 5 and 6 attached to the cylinder blocks 1 and 2 via front and rear valve plates 3 and 4.

The cylinder blocks 1 and 2 have a swash plate chamber 8 formed therein at an axially central portion. An axial drive shaft 10 is supported by the combined cylinder blocks 1 and 2 via front and rear anti-friction radial bearings 9 and arranged so as to be rotated about an axis of rotation thereof corresponding to the central axis of the combined cylinder blocks 1 and 2. The drive shaft 10 fixedly supports thereon a swash plate 11 so that the swash plate 11 is rotated together with the drive shaft;10 in the swash plate chamber 8.

The cylinder blocks 1 and 2 are provided with a plurality of axial cylinder bores 12 formed around the axis of rotation of the drive shaft 10, and receiving therein reciprocating pistons 13. Each reciprocating piston 13 is engaged with the swash plate 11 via a pair of shoes 14. Thus, when the drive shaft 10 is rotated together with the swash plate 11, the respective pistons 13 are reciprocated in the cylinder bores 12 due to the rotating of the swash plate 11.

The front and rear housings 5 and 6 are provided with front and rear suction chambers 16 and 17 formed therein, and communicate-with one another via the swash plate chamber 8 and a pair of suction passageways 20 and 21. The front and rear housings 5 and 6 are also provided with front and rear discharge chambers 18 and 19 which communicate with one another via a pair of discharge passageways (not shown).

The front and rear suction chambers 16 and 17 fluidly communicate with the respective cylinder bores 12 via front and rear suction ports 22 and 23 formed in the front and rear valve plates 3 and 4. Similarly, the front and rear discharge chambers 18 and 19 fluidly communicate with the respective cylinder bores 12 via front and rear discharge ports 24 and 25 formed in the front and rear valve plates 3 and 4. The front and rear suction ports 22 and 23 are closed by front and rear suction valves 26 and 27 attached to the respective inner faces of the front and rear valve plates 3 and 4, and the front and rear discharge ports 24 and 25 are closed by front and rear discharge valves 28 and 29 arranged adjacent to the outer faces of the front and rear valve plates 3 and 4.

It should generally be noted that the compressor is mounted in an engine compartment of an automobile in a horizon%al position, as shown in FIG. 3, in which the central axis of the combined cylinder blocks 1 and 2, and accordingly, the axis of rotation of the drive shaft 10 lie in a substantially horizontal plane.

Figure 4:
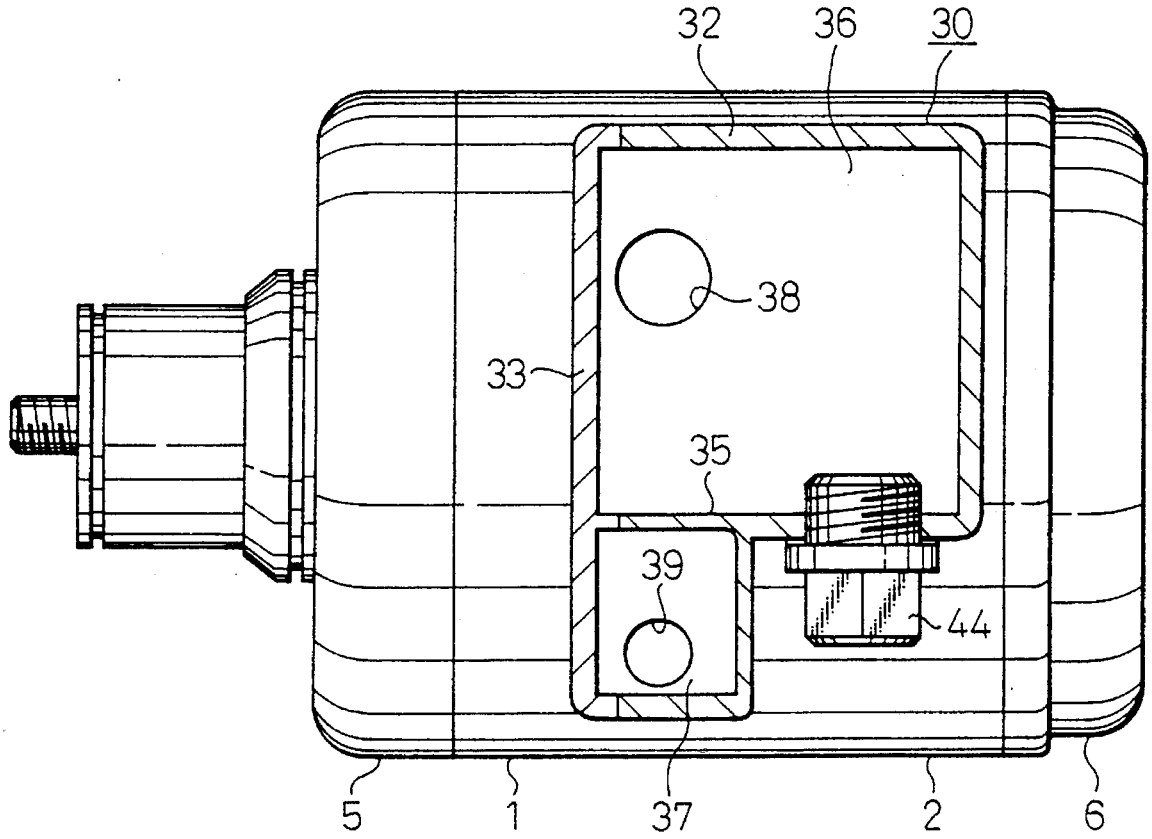
FIG. 4 is a cross-sectional view of the muffling unit integrally formed around the outer circumference of the cylinder block of the compressor of FIG. 1.

Referring now to FIGS. 1 through 4, the compressor is provided with an upright muffling chamber 30 arranged outside and integrally formed with the combined cylinder blocks 1 and 2. Namely, the muffling chamber 30 is defined as a chamber entirely enclosed by upright walls 32 and 33 extending upward from the outer circumference of the combined cylinder blocks 1 and 2. The upright wall 32 is formed as an integral part of the rear cylinder block 2, and the upright wall 33 is formed as an integral part of the front cylinder block 1. The muffling chamber 30 is provided with a large upright discharge pulsation damping chamber 36 and a small upright suction pulsation damping cheer 37 formed therein, in such a manner that the chambers 36 and 37 are openings fluidly isolated from one another by a partition wall 35 and defining upward. The discharge and suction pulsation damping chambers 36 and 37 are formed as a square chamber as best shown in FIG. 4. The muffling cheer 30 has a bottom surface 31 formed by a part of the upper surface portion of the outer circumference of the rear cylinder block 2.

The muffling chamber 30 is hermetically closed by a covering plate 34 which is formed integrally with the upright wall 32, i.e., the rear cylinder block 2. The covering plate 34 may be separate from the upright wall 32 as required.

Figure 1:
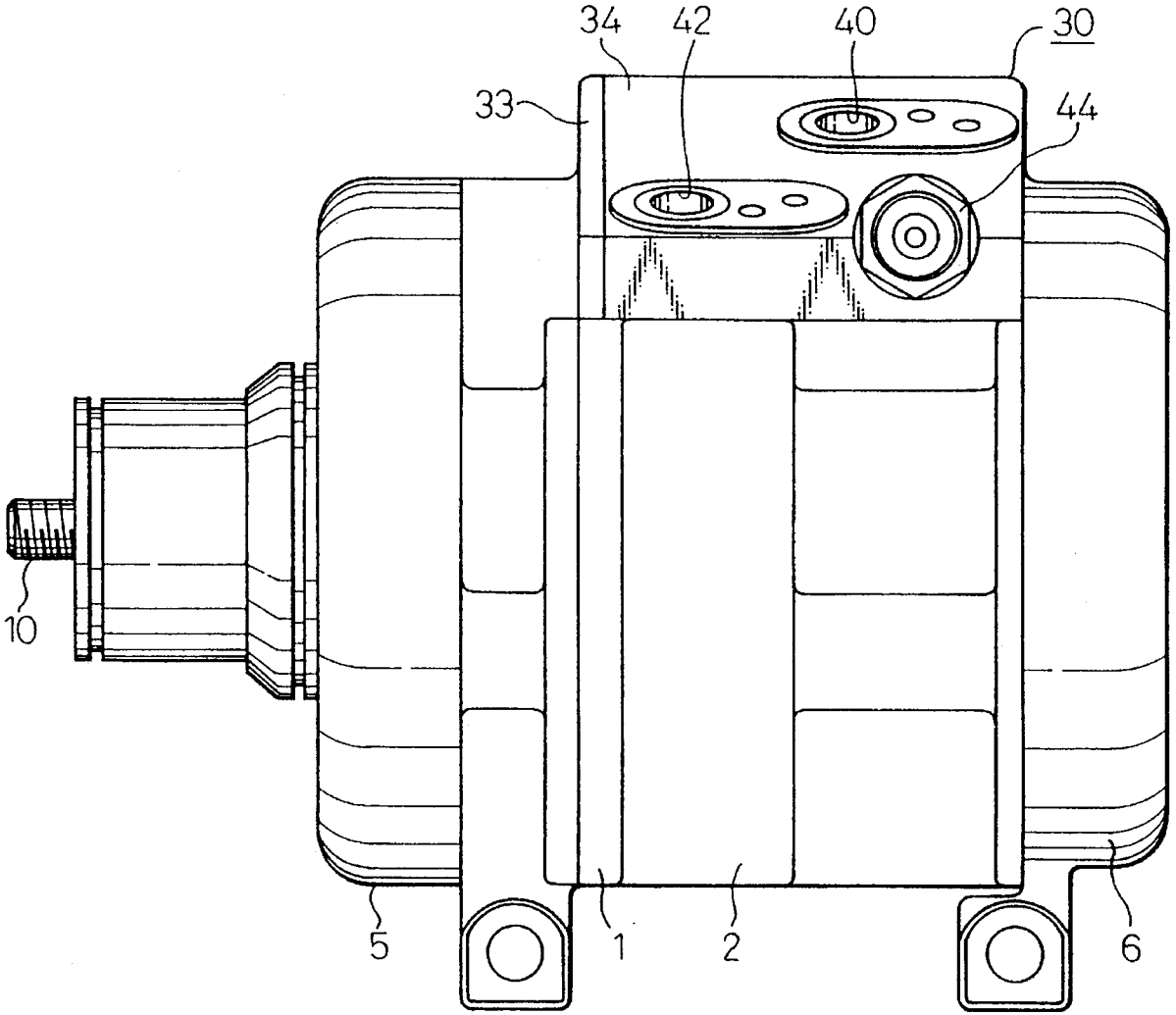
FIG. 1 is an outer view of a multi-piston-swash plate type refrigerant compressor provided with an integral muffling chamber according to the present invention.
Figure 2:
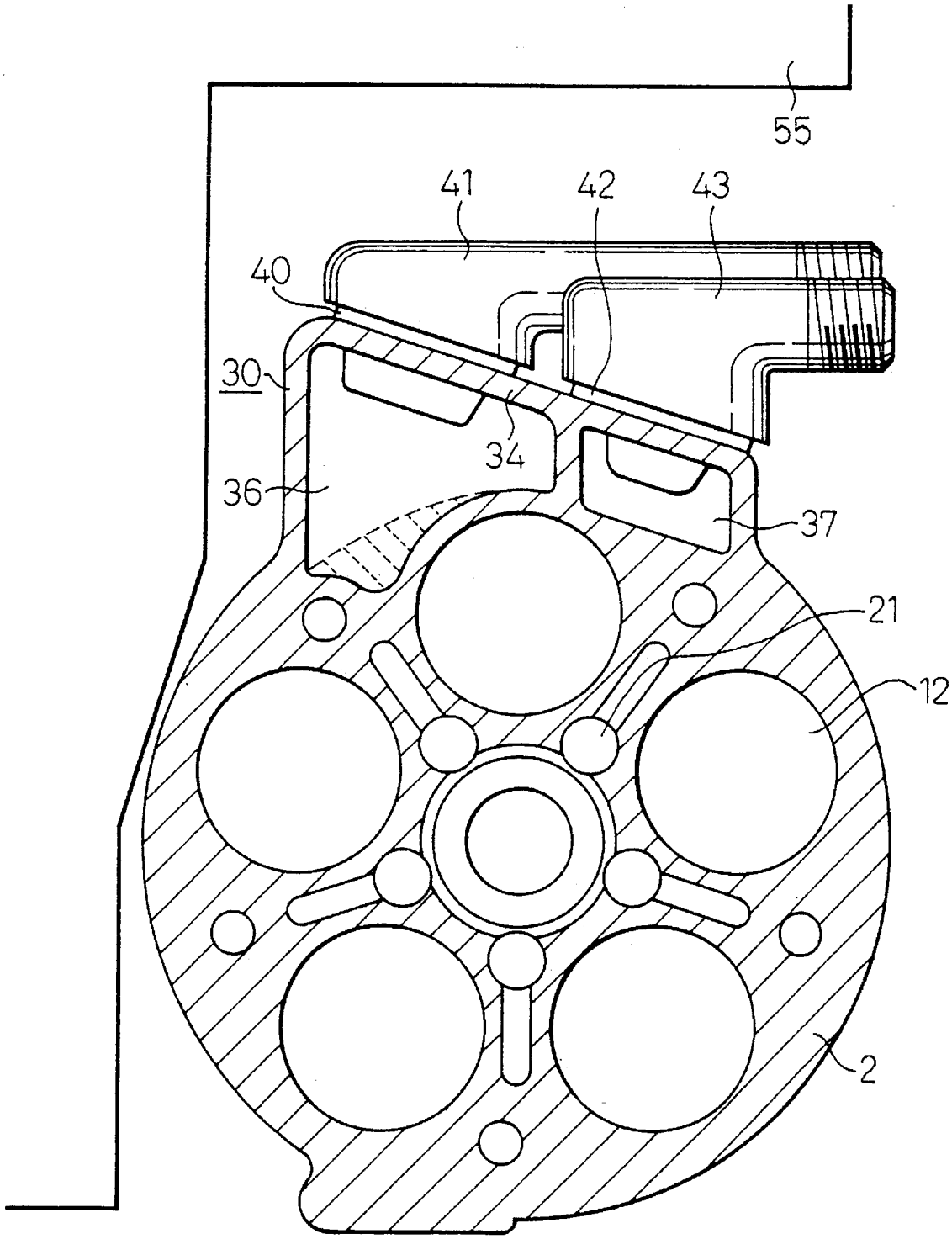
FIG. 2 is a cross-sectional view of the compressor of FIG. 1, taken along a line perpendicular to a longitudinal axis of the compressor, illustrating an arrangement of the muffling unit in the shape of a chamber, according to a typical embodiment of the present invention.

It should be noted that, as best shown in FIG. 2, the upright walls 32, 33 and the covering plate 34 are formed so as to provide the muffling chamber 30 with an uppermost face which is inclined or sloped with respect to a horizontal plane at a predetermined angle when the compressor is arranged in the engine compartment. Namely, the uppermost face of the covering plate of the muffling chamber 30 is downwardly sloped towards one lateral side of the cylindrical body of the compressor, so that an operator may easily access the uppermost face of the covering plate 34 during the operation for mounting the compressor per se and for arranging pipes and hoses in the engine compartment.

Within the muffling chamber 30, the suction pulsation damping chamber 37 is located lower than the discharge pulsation damping chamber 36. It should here be noted that the inclined arrangement of the upright walls 32 and 33 is contrived so that the volumes of the respective discharge and suction pulsation damping chambers 36 and 37 are not reduced compared with those of the prior art muffling chamber shown in FIGS. 5 and 6.

The bottom surface 31 of the discharge pulsation damping chamber 36 is formed in the rear cylinder block 2 so as to have a recessed portion schematically shown by hatched lines in FIG. 2.

A delivery port 38 is arranged in the discharge pulsation damping chamber 36 and formed as a round port (FIG. 4) bored in the bottom surface 31, i.e., in the rear cylinder block 2. Thus, the discharge pulsation damping chamber 36 is fluidly communicated with the front and rear discharge chambers 18 and 19 of the front and rear housings 51 and 6 so that the compressed refrigerant gas can flow from the two discharge chambers 18 and 19 towards the discharge pulsation damping chamber 36 via the delivery port 38.

A suction port 39 is arranged in the suction pulsation damping chamber 37 and formed as a round port (FIG. 4) bored in the bottom surface 31 of the chamber 37, i.e., in the rear cylinder block 2. The suction port 39 provides a fluid communication between the suction pulsation damping chamber and the swash plate chamber 8 of the combined cylinder blocks 1 and 2.

A first connecting port 40 by which the delivery gas pipe 41 is connected to the muffling chamber 30 is arranged in the covering plate 34 at a position opening into the discharge pulsation damping chamber 36. A second connecting port 42 by which the suction gas pipe 43 is connected to the muffling chamber 30 is arranged in the covering plate 34 at a position opening into the suction pulsation damping chamber 37. Thus, the refrigerant gas returning from the airconditioning system is introduced, through the suction gas pipe 43 into the suction pulsation damping chamber 37 of the muffling chamber 30.

A relief valve 44 is fixed to the upright wall 32 at a position corresponding to the discharge pulsation damping chamber 36 in order to prevent an abnormal rise in the discharge pressure of the compressed refrigerant gas in the discharge pulsation damping chamber 36, and the front and rear discharge chambers 18 and 19 of the compressor. Namely, when an abnormal rise in the compressed refrigerant gas occurs, the relief valve 44 opens so as to permit a part of the compressed refrigerant gas to flow from the discharge pulsation damping chamber 36 into the atmosphere.

In the multi-piston-swash-plate type compressor, the refrigerant gas flowing through the airconditioning system is returned into the compressor via the suction gas pipe 43. The refrigerant gas initially enters the suction pulsation damping chamber 37 via the second connecting port 42, and subsequently flows into the swash plate chamber 8. The refrigerant gas further flows from the swash plate chamber 8 into the front and rear suction chambers 16 and 17 via the suction passageways 20 and 21, and is then sucked into the respective cylinder bores 12 in which the refrigerant gas is compressed by the reciprocating pistons 23. The compressed refrigerant gas is discharged from the respective cylinder bores 12 toward the discharge chamber 18 and 19 of the front and rear housings 5 and 6. The compressed refrigerant gas further flows into the discharge pulsation damping chamber 36 so that the discharge pulsation is damped, and the damped refrigerant gas is delivered towards the airconditioning system via the first connecting port 40 and the delivery gas pipe 41.

At this stage, it should be understood that since the uppermost face of the covering plate 34 of the muffling chamber 30 is sloped so as to reduce the height of the suction pulsation damping chamber 37 in comparison with that of the discharge pulsation damping chamber 36, the refrigerant gas entering the suction pulsation damping chamber 37 can immediately flow into the swash plate chamber 8 via the suction port 39 without being heated or warmed by the compressed refrigerant gas in the discharge pulsation damping chamber 36. Namely, the heat of the compressed refrigerant gas is transmitted to the refrigerant gas before compression within the suction pulsation damping chamber 37 only through the low partition wall 35 which has, therefore, a small surface area. Accordingly, the refrigerant gas before compression is not thermally affected by the compressed refrigerant gas in the muffling chamber 30. Thus, a reduction in the density of the refrigerant gas before compression can be prevented resulting in achieving of a high compression efficiency of the compressor.

Further, as is best understood from the illustration of FIG. 2, when the delivery and suction gas pipes 41 and 43 are attached to the first and second connecting ports 40 and 42 of the muffling chamber 30, an operator can easily access the ports 40 and 42 due to the inclined arrangement of the upright walls 32, 33, and the covering plate 34 with respect to a horizontal plane. Accordingly, the operation for arranging the delivery and suction gas pipes 41 and 43 and the running of the hoses in the narrow engine compartment can be simplified and easily achieved. Further, since the delivery and suction gas pipes 41 and 43 do not need any neck portion at an extreme end thereof, a large space is not needed between the muffling chamber 30 and the other automobile part 55 in the engine compartment. Thus, the mounting of the multi-piston-swash-plate type compressor in the narrow engine compartment of an automobile can be easily achieved.

The recessed bottom portion (see FIG. 2) of the bottom surface 31 of the discharge pulsation damping chamber 36 is useful for sufficiently increasing the volume of the chamber 36, and accordingly, the damping of the discharge pulsation can be effectively achieved in spite of the inclined or sloped arrangement of the muffling chamber 30.

Moreover, the arrangement of the inclined covering plate 34 can contribute to enhancing the damping effect of the discharge pulsation of the compressed refrigerant gas when the gas flows into the discharge pulsation damping chamber 36 from the discharge chambers 18 and 19 of the compressor. Namely, the inclined covering plate 34 smoothly changes the direction of flow of the compressed gas within the discharge pulsation damping chamber 36, and accordingly, the discharge pulsation and noise components generated by the compressed refrigerant gas can be effectively attenuated.

Further, the inclined arrangement of the muffling chamber 30 can reduce the height of the upright walls 32 and 33. Thus, the reduction of the height of the upright walls 32 and 33 and the recessed bottom surface 31 of the discharge pulsation damping chamber 36 can reduce the weight of the muffling chamber 30 resulting in a reduction in the weight of the entire compressor. When the covering plate 34 is integral with the upright wall 32 of the rear cylinder block 2, the number of parts of the compressor can be reduced.

From the foregoing, it will be understood that according to the present invention, the multi-piston-swash plate type refrigerant compressor provided with an integral muffling chamber can be easily mounted in a small and narrow mounting space within an engine compartment of an automobile, and that the operation for arranging pipes and hoses in the engine compartment can be simplified. Further, the entire weight of the compressor can be reduced.

Many modifications and variations can be made without departing from the scope of the accompanying claims. For example, the muffling chamber may be formed by the upright walls of the combined cylinder blocks in such a manner that the suction pulsation damping chamber and the discharge pulsation damping chamber are spaced apart from one another on the outer circumference of the combined cylinder blocks of the compressor.

Further, the described integral muffling chamber may be applied to multi-piston type refrigerant compressors different from the described swash plate type compressor. For example, the integral muffling chamber according to the present invention may be provided for a multi-piston wobble-plate type compressor.

We claim:

1. A multi-piston type refrigerant compressor provided with a muffling means, which comprises:

a cylinder block means having a horizontally extending central axis, and a generally cylindrical body portion defined around the central axis and having a plurality of cylinder bores arranged equidistantly around the horizontal central axis;

a plurality of piston elements reciprocating in said plurality of cylinder bores to implement suction of a refrigerant gas, compression of the refrigerant gas, and discharge of the compressed refrigerant gas;

an upright wall means extending from an upper portion of said cylindrical body portion so as to define enclosed upright chambers having upward openings, said enclosed upright chambers having an appreciable amount of volume; and a plate-like covering means for covering said upward openings of said enclosed upright chambers to form; said muffling means including a suction pulsation damping chamber and a discharge pulsation damping chamber hermetically isolated from said suction pulsation damping chamber by a partition wall means arranged between said enclosed upright chambers, said plate-like covering means being provided, therein, with a suction gas introducing port to which a suction gas pipe is connected, and a discharge gas delivering port to which a delivery gas pipe is connected, wherein said upright wall means is formed so as to define an uppermost end thereof extending around said upward openings and lying in a plane inclined with respect to a horizontal plane containing therein said horizontal central axis of said cylindrical body of said cylinder block means to thereby allow said plate-like covering means to be inclined.

2. A multi-piston type refrigerant compressor provided with a muffling means according to claim 1, wherein said suction pulsation damping chamber is situated lower than said discharge pulsation damping chamber with respect to said horizontal plane containing therein said horizontal central axis of said cylindrical Body of said cylinder block means.

3. A multi-piston type refrigerant compressor provided with a muffling means according to claim 1, wherein said suction pulsation damping chamber and said discharge pulsation damping chamber of said muffling means are provided with bottom surfaces arranged opposite to said upright openings of said muffling means and said bottom surface of said discharge pulsation damping chamber is recessed into said cylindrical body portion.

4. A multi-piston type refrigerant compressor provided with a muffling means according to claim 1, wherein said upright wall means is integral with said cylindrical body portion of said cylinder block means.

5. A multi-piston type refrigerant compressor provided with a muffling means according to claim 1, wherein said plate-like covering means is formed to be integral with said upright wall means.

6. A multi-piston type refrigerant compressor provided with a muffling means according to claim 1, wherein said plate-like covering means is inclined towards one of the opposite sides of said cylindrical body portion of said cylinder block means.

7. A multi-piston type refrigerant compressor provided with a muffling means according to claim 6, wherein said suction pulsation damping chamber of said muffling means is situated at a position lower than that of said discharge pulsation damping means.

8. A multi-piston type refrigerant compressor provided with a muffling means according to claim 6, wherein said suction and discharge pulsation damping chambers of said muffling means are formed so as to have a square shape.

* * * * *